United States Patent [19]

Hefele

[11] Patent Number: 4,471,692

[45] Date of Patent: Sep. 18, 1984

[54] DEVICE FOR THE PRINTING OF FLEXIBLE FLAT PARTS

[75] Inventor: Josef Hefele, Gräfelfing, Fed. Rep. of Germany

[73] Assignee: Kufner Textilwerke GmbH, Munich, Fed. Rep. of Germany

[21] Appl. No.: 482,198

[22] Filed: Apr. 5, 1983

[30] Foreign Application Priority Data

Sep. 6, 1982 [DE] Fed. Rep. of Germany ..... 3233061

[51] Int. Cl.[3] ..... A41D 27/06

[52] U.S. Cl. ..... 101/157; 118/245

[58] Field of Search ..... 101/170, 150, 153, 157; 118/245

[56] References Cited

U.S. PATENT DOCUMENTS

| | | | |
|---|---|---|---|
| 365,972 | 7/1887 | Dale | 101/232 |
| 419,399 | 1/1890 | Ainsworth et al. | 101/232 X |
| 501,816 | 7/1893 | Barnard | 101/232 |
| 581,056 | 4/1897 | Bodkin | 118/245 |
| 853,480 | 5/1907 | Smith | 118/245 |
| 917,857 | 4/1909 | Faifer | 118/245 |

FOREIGN PATENT DOCUMENTS 3014656 10/1981 Fed. Rep. of Germany .

*Primary Examiner*—Clifford D. Crowder

*Attorney, Agent, or Firm*—Scully, Scott, Murphy & Presser

[57] ABSTRACT

A device for the printing of flexible flat parts such as cuts or single parts of fabrics, wefts, fleeces, leather, furs or the like with pasty substances in the photogravure printing process. The device has a printing roller to be painted with paste, and a counter-print roller with print gap therebetween. In the area of said gap a group of adjacent yarns runs around a part of the periphery of the printing roller, and is then drawn off above a discharge device for the flat parts from the printing roller. This yarn group is moved at a velocity differing from that of the periphery of the printing roller. It can be moved either in the same or opposite direction as the peripheral motion of the rollers in the area of the printing gap. This makes possible an exact deposit of the printed flat parts on the discharge device and also reduces the paste consumption, with the minimum of constructional costs.

17 Claims, 2 Drawing Figures

Figure 1:
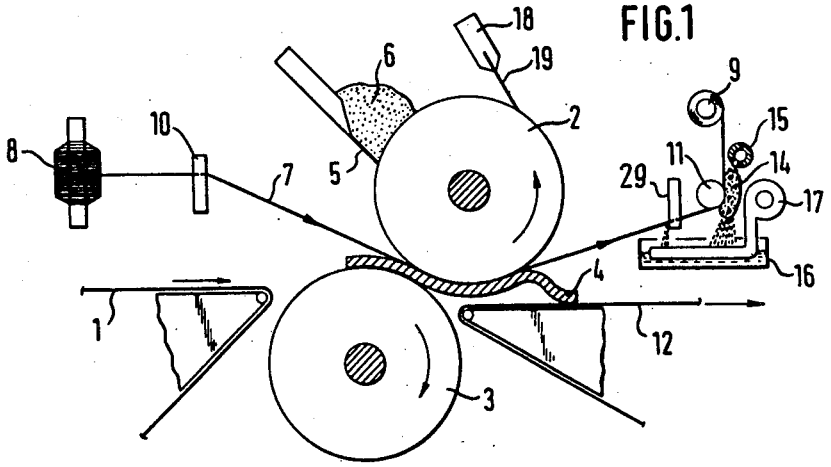

18
19
6
9
2
15
8
10
7
5
11
14
29
17
4
16
1
12
3

18
19
6
27
26
25
2
22
20
5
23
24
21
28
4
1
12
3

DEVICE FOR THE PRINTING OF FLEXIBLE FLAT PARTS

The present invention relates to a device for printing flexible flat parts such as cuts or single parts of fabrics, wefts, fleeces, natural leather, synthetic leather, furs or the like, with pasty substances in the photogravure printing process. Such a device is known from German Offenlegungsschrift No. 30 14 656, which for the printing of flat parts is suitable when using pastes of the most varied viscosity. With this device a yarn group and the periphery of a printing roller move in the area of the printing gap at the same speed and in the same direction. But problems arise because it is difficult to place the flat parts exactly on the discharge device.

An object of the invention is to make possible with a device of the type named above a satisfactory and adequately exact placing of the printed flat parts on the discharge device at low cost.

A further object of the invention is to reduce excessive paste consumption, which with the known devices is caused by the fact that one part of the paste adheres to the yarn group and has to be cleaned off. Both objects are achieved according to the invention in that the yarn group (which may contain a single yarn) is moved at a speed which differs from that of the periphery of the printing roller. Thus the speed of the yarn group should amount to only 1/200th to ⅓rd of the peripheral speed of the printing roller. Due to this relatively large difference in the speed of the yarn group as against the peripheral speed of the printing roller and thus of the flat parts moved through the print gap, the removal of the flat parts from the yarn group and their deposit on the discharge device are favoured so that no further measures are required. The paste comsumption is moreover reduced.

Figure 2:
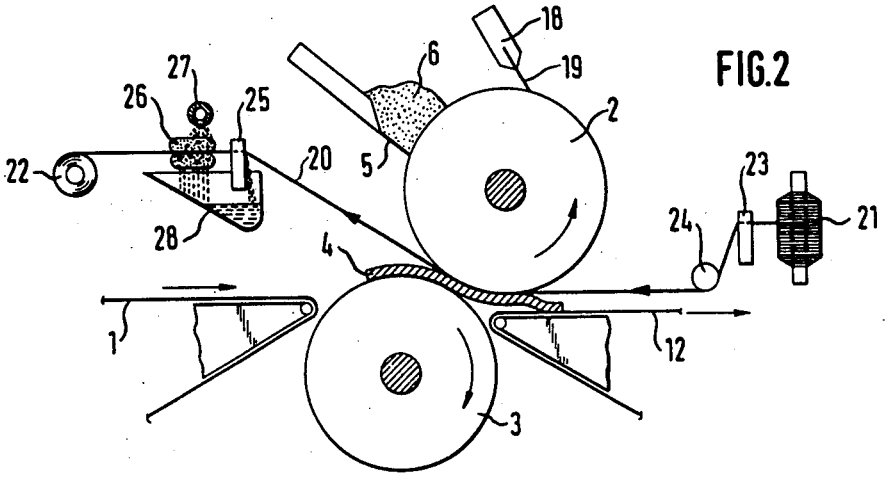

In the drawing which shows schematically two preferred and exemplary embodiments of a device according to the invention, and will be described in more detail below:

FIG. 1 shows a side view of a device according to a first embodiment of the invention; and FIG. 2 illustrates a side view of a device according to a second embodiment of the invention.

In the embodiment shown in FIG. 1, an edge-controlled endless conveyor belt 1 leads to two printing rollers 2, 3 arranged obliquely to each other. The upper printing roller is provided with an engraved surface while the lower counter-roller 3 is designed as a smooth steel roller or as a roller with a relatively smooth rubber coating. The rollers define therebetween a print gap through which the flat parts 4 are led, coming from the endless conveyor belt 1.

The lower counterprint roller 3 rotates in the clockwise direction, the upper printing roller 2 in the opposite direction, but at the same peripheral speed. Upper printing roller 2 rotates past a wiper 5 which applies printing paste 6 into the engraving on the surface of printing roller 2.

In the rotary direction of printing roller 2 behind the wiper 5 juxtaposed yarns of a group 7 spaced at e.g. 2 to 5 mm abut this roller over a portion of its periphery which are wound on the supply side of the printing rollers from yarn rolls 8 and on the discharge side of the printing rollers are wound onto rolls, rollers, or bobbins 9 so that the yarns move in the same direction as the printing rollers 2, 3 in the print gap. But the motion of the yarn group is considerably slower than the peripheral speed of the printing rollers 2 and 3. Thus the speed of the yarn group can be 1/100 or ⅓rd of the peripheral speed of the printing rollers 2, 3. Especially preferred is a speed of the yarn group from about 1/50th to 1/10th of the peripheral speed of said printing rollers.

The yarn group 7 is moved via grooves or the like of a guide strip 10 to the printing roller 2, and from it via the deflector rollers 11 to the winding roller 9.

The yarn group can also be formed by circulating endless yarns as in the case of e.g. German laid-open application No. 30 14 656. The endless yarns are led spaced from the printing roller via deflector rollers or rolls to return to the supply side. The yarn group can consist of a single endless circulating yarn which is led repeatedly around the printing roller as well as via deflector rollers and after each cycle is offset by guide rolls by a part of the axial length of said printing rollers. But since the yarns, in the case of the invention, because of their substantially lower speed than the peripheral speed of the printing roller slide along it, they would have to be designed, when in the form of endless yarns with ever-repeated use, of very friction resistant material, e.g. of fine metal wire or of abrasion resistant synthetic yarns, preferably of monofilament yarns.

Due to the above-mentioned substantially lower speed of the yarn group against that of the periphery of the printing roller 2, the flat parts led through the print gap are safely deposited on the discharge device beginning under the printing roller 2, which in turn consists of an endless conveyor belt 12. The release of the printed flat parts 4 from the yarn group 7 takes place fairly exactly at the point where the yarn group running in the same direction leaves the printing roller.

Since residues of the paste 6 painted by wiper 5 stay on the surface of the yarn 7 running from the printing roller 2, a device for the wet wiping of the yarn is provided on the deflector roller 11 which is preceded by a guide and wiping roller 29. Said wet wiping device comprises a sponge-type structure 14 with a water supply 15 and a driptray 16 below it, out of which the paste and water mixture is removed by a drainage device 17. To remove loose fibers which may be deposited on the printing roller 2 during the printing process, released from the flat parts 4, a needle comb 18 is provided in the peripheral motion direction of the printing roller 2 before the wiper 5 which combs out the impurities with the tips of its needles 19 abutting the roller surface.

The embodiment shown in FIG. 2 is the same as that of FIG. 1 as regards the arrangement and the rotary motion of the printing roller 2 and the counterprint roller 3, with the print gap between them, the supply device 1 and the discharge device 12 for the flat parts 4 to be printed and the paste application arrangement in the form of the wiper 5. It differs however in the guidance of the yarn group and in the device for wiping the yarns.

In this embodiment the yarns of the yarn group 20, which also circulates in the area of the print gap around a part of the periphery of printing roller 2, are moved in the contrary direction to the peripheral motion of the two rollers 2, 3 in the area of the print gap. For this purpose the yarns are drawn off in the peripheral motion direction of the rollers 2, 3 behind them by the yarn rolls 21, and are led via deflector rolls 24 and a guide strip 23 to the printing roller 2. After abutment on a small portion of the roller periphery, these yarns are led upward at an incline to the other side of the printing rollers by means of the guide strip 25 and are then wound onto rolls, rollers or bobbins 22. Between said guide strip 25 and the rolls, rollers or bobbins, the yarns pass through a wiper unit which consists of a sponge-type structure 26 abutting the yarns on both sides with a water supply 27 above it and a driptray 28 below it as well as a drainage device which is not shown.

In the case of this embodiment too the speed of the yarns of the host is substantially smaller, about 1/200 to 1/10th, than the peripheral speed of the rollers 2, 3. Due to the contrary motion of the yarn group 20 against the peripheral motion of the rollers 2, 3 and to the motion of the flat parts now printed, not only is the exact deposit of the flat parts in safety on the discharge device 12 consisting of an endless conveyor belt ensured, but also the transport speed of the yarn group can be chosen to be slower with the same paste viscosity, which reduces the paste consumption.

Due to the reversed direction of motion of the yarn group 20 there is no need for the wiper device above the discharge device 12. Therefore the yarn group can be supplied at lower spacing above the conveyor belt for the discharge of the flat parts 4 and approximately parallel to this conveyor belt to the printing roller 2, which provides a very small dropping height for the printed flat parts. This favors a clean and even deposit of the flat parts on the discharge device 12. The release of the printed flat parts from the yarn group 20 takes place with this embodiment exactly at the point at which the yarn group coming from the opposite direction contacts the printing roller 2.

It has been found that the yarn group running in the contrary direction 20 in the embodiment of FIG. 2 is covered with less paste material than yarn group 7 in the embodiment of FIG. 1, which leads to a reduction in paste consumption. Therefore the wiper unit 26, 27, 28 is also less costly and needs less cleaning water.

In the embodiment according to FIG. 2 there is also a needle comb 18, which can be supplemented by a further needle comb. Here too the yarn group 20 can be formed from circulating endless yarn.

In both embodiments it is advisable for the discharge device consisting of an endless conveyor belt 12 for the flat parts 4 to run at a speed at least 10% greater than the peripheral speed of the printing rollers 2, 3. Thus it is possible to deposit the flat parts 4 after printing uncrumpled or extended on the discharge device 12 and then to supply them to further processing devices, for example a unit for the flocking of the printed parts in a high tension field, after which and optionally after a precleaning device, means for the predrying or coagulation of the printed paste can follow with a post-cleaning installation and stacking.

After leaving the flocking device the flat parts can be supplied to a device for effecting a condensation reaction in the print paste, the flat parts passing under pressure in a steam atmosphere with substantial exclusion of incoming air.

Thus, the motion of the yarn group can be in the direction of motion of the periphery of the printing roller in the area of the print gap. But especially favourable results are attained when the yarn group is moved in the opposite direction to the peripheral motion of the printing roller. Whereas with motion of the yarn group in the direction of peripheral motion of the roller and at paste viscosities which are higher than about 50,000 m.Pa.s with measuring device SV 1, rpm 5.8 using the Haake Viscotester model VT 23, the bulging of the paste on the yarn group at its lower transport speed is relatively large, and its reduction again makes it necessary to increase the transport speed of the yarn group which is a disadvantage for paste consumption, when the opposite direction of motion of the yarn group is caused, this disadvantage scarcely appears. Using this opposite direction of motion of the yarn group, even at lower transport speeds of the yarn group, there is no bulge formation and also the amount of paste adhering to the yarn group is very small, so that under certain circumstances a wiper unit is not needed after passage of the yarns through the print gap. This also leads to considerably reduced paste consumption and to lower constructional costs. Even when a wiper unit is provided for the yarn group, it needs a lower expenditure on cleaning materials.

Both with the reduced motion of the yarn group in the direction of the periphery of the printing roller and in the opposite direction, the flat parts are fairly exactly removed, in the first case at the point where the yarn group runs onto the periphery of the printing roller, and in the second case at the point where the group leaves the periphery of said roller.

Since on the discharge side of the printing rollers using the opposite movement direction of the yarn group, a wiper unit is omitted for the yarn group in each case, the yarn group can be brought at lower spacing above the conveyor belt of the discharge device approximately parallel to it to the printing roller, which leads to a very small dropping height for the flat parts. On the other hand the yarn group, after passage through the print gap, can be led upwards on the supply side of the printing rollers relatively steeply from the top printing roller, so that between the yarn group and the conveyor belt of the supply device for the flat parts there is plenty of space available in the vertical direction for the arrangement of a wiper unit to the extent that it is needed at all. With the embodiment using the opposite direction of motion of the yarn group, the speed of the yarn group, as a rule, can be lower than using the embodiment in which the yarn group moves in the same direction as the periphery of the printing rollers. The higher the speed of the oppositely moved yarn group, the higher the paste viscosities which can be used in both cases. Thus with an opposite motion of the yarn group and at a paste viscosity of 52,000 m.Pa.s and a printing speed of 2 m/min. a yarn speed of about 6 cm/min. is enough to avoid paste bulging on the yarn group, which leads to the dripping of paste onto the printed flat parts passing under the yarn group.

I claim:

1. Device for the printing of flexible flat parts, such as cuts or single parts of fabrics, wefts, fleeces, natural leather, synthetic leather, furs or the like, with pasty substances in the photogravure printing process, said device comprising: a pair of rollers including a printing roller and a counter-printing roller defining a print gap therebetween, through which flat parts to be printed can be moved; a paste-application means adjacent said printing roller; and means for moving a yarn group in the region of said print gap around a part of the periphery of the printing roller at a velocity differing from the peripheral velocity of the printing roller with the yarns spaced and juxtaposed in the axial direction of the printing roller; and means for drawing off the yarn of the the printing rollers behind the print gap and on the side of the printing rollers which is behind these rollers seen in the direction of the movement of the flat parts.

2. Device according to claim 1 wherein a discharge device for said flat parts is provided below said means for drawing off.

3. Device according to claim 2 wherein the discharge device disposed behind the roller gap for the printed flat parts leads to a device for the flocking of the printed flat parts in an electrical high tension field.

4. Device according to claim 3 wherein means are provided behind said flocking device for at least one of predrying, coagulating and effecting a condensation reaction in the printing paste.

5. Device according to claim 1 wherein the speed of motion of the yarn is 1/200 to ⅓rd that of the periphery of the printing roller.

6. Device according to claim 1 wherein the yarn group is moved in the direction of the peripheral motion of the printing roller in the region of the print gap.

7. Device according to claim 1 wherein the yarn group is moved in the opposite direction to that of the periphery of the printing roller in the area of the print gap.

8. Device according to claim 1 wherein yarn rolls are provided for drawing off the yarn group on the supply side of the printing roller and rolls, rollers or bobbins are provided on the discharge side of the printing roller.

9. Device according to claim 1 wherein deflector rollers are provided for leading one or more endless yarns of the yarn group spaced from the printing roller.

10. Device according to claim 9 wherein the yarn group comprises one single circulating endless yarn, which is led away round the printing roller repeatedly as well as via the deflector rollers; and after every circuit is offset by guide rolls in the axial direction of the printing roller.

11. Device according to claim 1 wherein the yarn group consists of abrasion resistant yarns, e.g. metal yarns.

12. Device according to claim 1 wherein the yarn comprises at least one multifilament yarn which is wrapped in elastic plastics substances and whose filaments are wound at both yarn ends into endless yarn formed by twisting or plaiting the filaments of one yarn end with the filaments of the other yarn end to connect both yarn ends of each yarn.

13. Device according to claim 1 wherein the discharge device is located in the direction of the movement of the printed flat parts behind said rollers and can be driven at greater transport speed than the peripheral speed of the printing rollers.

14. Device according to claim 13 wherein the discharge device can be driven at a speed at least 10% greater than the peripheral speed of the printing rollers.

15. Device according to claim 1 wherein the yarn group passes a device for wet wiping the yarns in its direction of motion behind the pair of printing rollers.

16. Device according to claim 15 wherein a device for the wet wiping of the yarn of the yarn group comprises a sponge-type structure with a water supply, under which a driptray is disposed with an outlet for the amount of water and paste dropping from the structure and wiped from the yarns respectively.

17. Device according to claim 16 wherein on the printing roller rotating past the paste application device in the peripheral direction of said roller and before the application device needle points of a needle comb for the combing out of impuritites abut the surface of the roller.

* * * * *